United States Patent [19]

Shibayama et al.

[11] Patent Number: 4,480,933

[45] Date of Patent: Nov. 6, 1984

[54] GUIDING DEVICE FOR PRINTING PAPER STRIP IN A NONIMPACT PRINTER

[75] Inventors: Tooru Shibayama, Sagamihara; Hiroshi Kajiya, Hachiouji, both of Japan

[73] Assignee: Kabushiki Kaisha Sato, Japan

[21] Appl. No.: 485,033

[22] Filed: Apr. 14, 1983

[30] Foreign Application Priority Data

Apr. 16, 1982 [JP] Japan ..... 57-62353

[51] Int. Cl.[3] ..... B41J 15/00

[52] U.S. Cl. ..... 400/120; 400/615.2; 400/619

[58] Field of Search ..... 400/615.2, 120, 611, 400/613, 614.1, 617, 618, 619; 101/233, 234; 219/216

[56] References Cited

U.S. PATENT DOCUMENTS 4,119,974 10/1978 Ondis et al. ..... 346/145
4,347,006 8/1982 Shakib ..... 400/611

FOREIGN PATENT DOCUMENTS 124743 9/1979 Japan ..... 400/120
55277 5/1981 Japan ..... 400/120
63276 4/1982 Japan ..... 400/120
69079 4/1982 Japan ..... 400/120

*Primary Examiner*—Edgar S. Burr
*Assistant Examiner*—M. J. Hirabayashi
*Attorney, Agent, or Firm*—Ostrolenk, Faber, Gerb & Soffen

[57] ABSTRACT

A guide device for a printing paper strip in a nonimpact printer allows easy and reliable loading of the printing paper strip and may not cause separation of the printing paper strip from conveyor rollers or deviation of a printing position from the normal printing position. The guide device comprises an operation member, a printing paper guide member which is movable between a close position and a separated position with respect to a conveyance path of the printing paper strip in synchronism with operation of the operation member, a platen member for urging the printing paper strip against a printing head, and a link mechanism for moving the platen member between an urging position and a separated position with respect to the printing head in synchronism with the operation of the operation member.

13 Claims, 3 Drawing Figures

GUIDING DEVICE FOR PRINTING PAPER STRIP IN A NONIMPACT PRINTER

BACKGROUND OF THE INVENTION

1. Field of the Invention

The present invention relates to a guiding device for a printing paper strip in a nonimpact printer and, more particularly, to a structure which allows reliable and easy loading of a printing paper strip into such a printer.

2. Description of the Prior Art

As information is printed on a strip of printing paper with a thermal or electrostatic nonimpact printer, the strip of printing paper is guided by a printing paper guide member and a platen member. More specifically, the strip of printing paper is guided along a conveyance path by the printing paper guide member, while it is urged against a printing head by the platen member. When the strip of printing paper is loaded, the printing paper guide member is first moved away from the conveyance path while the platen member is separated from the printing head. At the same time, the strip of printing paper is inserted along the predetermined conveyance path.

Since the conventional guiding device has the structure described above, when the strip of printing paper is inserted along the predetermined conveyance path, the printing paper guide member and the platen member must be separately operated, resulting in cumbersome operation.

Furthermore, when the strip of printing paper is inserted to be positioned at a predetermined position and then the printing paper guide member and the platen member are set for guiding, the strip of printing paper may be shifted in the lengthwise and width directions by these members. This may cause separation of the strip from a conveyance roller or deviation of the printing position along the widthwise direction of the strip.

SUMMARY OF THE INVENTION

The present invention has been accomplished in view of the above-mentioned circumstances in the conventional art.

It is, therefore, the principal object of the present invention to provide an improved guiding device for a strip of printing paper in a nonimpact printer.

It is another object of the present invention to provide a guiding device for a printing paper strip in a nonimpact printer, which allows reliable and easy loading of the printing paper strip.

It is still another object of the present invention to provide a guiding device for a printing paper strip in a nonimpact printer, which may not allow separation of the strip from a conveyance roller or deviation of the printing position in the widthwise direction of the strip.

It is still another object of the present invention to provide a guiding device for a printing paper strip in a nonimpact printer, which is simple in structure, which is easy to manufacture and which is capable of operating without problems over a long period of time.

In accordance with the present invention, a guiding device for a printing paper strip in a nonimpact printer comprises an operation member, a printing paper guide member which is movable between a close or adjacent position and a separated position with respect to a conveyance path of the printing paper strip in synchronism with operation of the operation member, a platen member for urging the printing paper strip against a printing head, and a link mechanism for moving the platen member between an urging position and a separated position with respect to the printing head in synchronism with the operation of the operation member.

The operation of the operation member alone can move the printing paper guide member between the close and separated positions with respect to the conveyance path and can also move the platen member between the urging and separated positions with respect to the printing head, so that loading of the printing paper strip may be facilitated.

At least one of a pair of conveyor rollers for conveying the printing paper strip held therebetween is rotatable only in the conveyance direction, so that the printing paper strip may not be inadvertently moved by the setting operation of the printing paper guide member and the platen member.

The foregoing and other objects and features of the present invention will become more apparent from the following description of a preferred embodiment taken in conjunction with the accompanying drawings.

BRIEF DESCRIPTION OF THE DRAWINGS

FIGS. 2 and 3 are partially sectional side views showing a printer having a guiding device according to the present invention, wherein FIG. 2 is a view in the printing mode, and FIG. 3 is a view in the loading mode for the strip of printing paper.

DETAILED DESCRIPTION OF A PREFERRED EMBODIMENT

Figure 1:
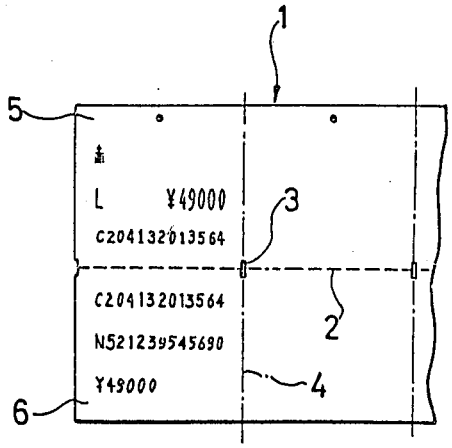
FIG. 1 is a plan view of a part of an example of a strip of printing paper.

FIG. 1 shows a part of a series of tags which are an example of a strip of printing paper 1 to be used in a guiding device of the present invention. Perforations 2 are formed along the center of the strip of printing paper 1 in its lengthwise direction. Detection holes 3 are formed at equal intervals along the line of perforations. An imaginary line which crosses the perforations 2 perpendicularly at each detection hole 3 indicates a cutting line 4 at which each tag may be cut off from the rest of the strip. Each tag thus obtained may be separated along the perforations 2 into a price tag 5 on which general characters are printed and a data tag 6 on which OCR characters are printed.

Figure 2:
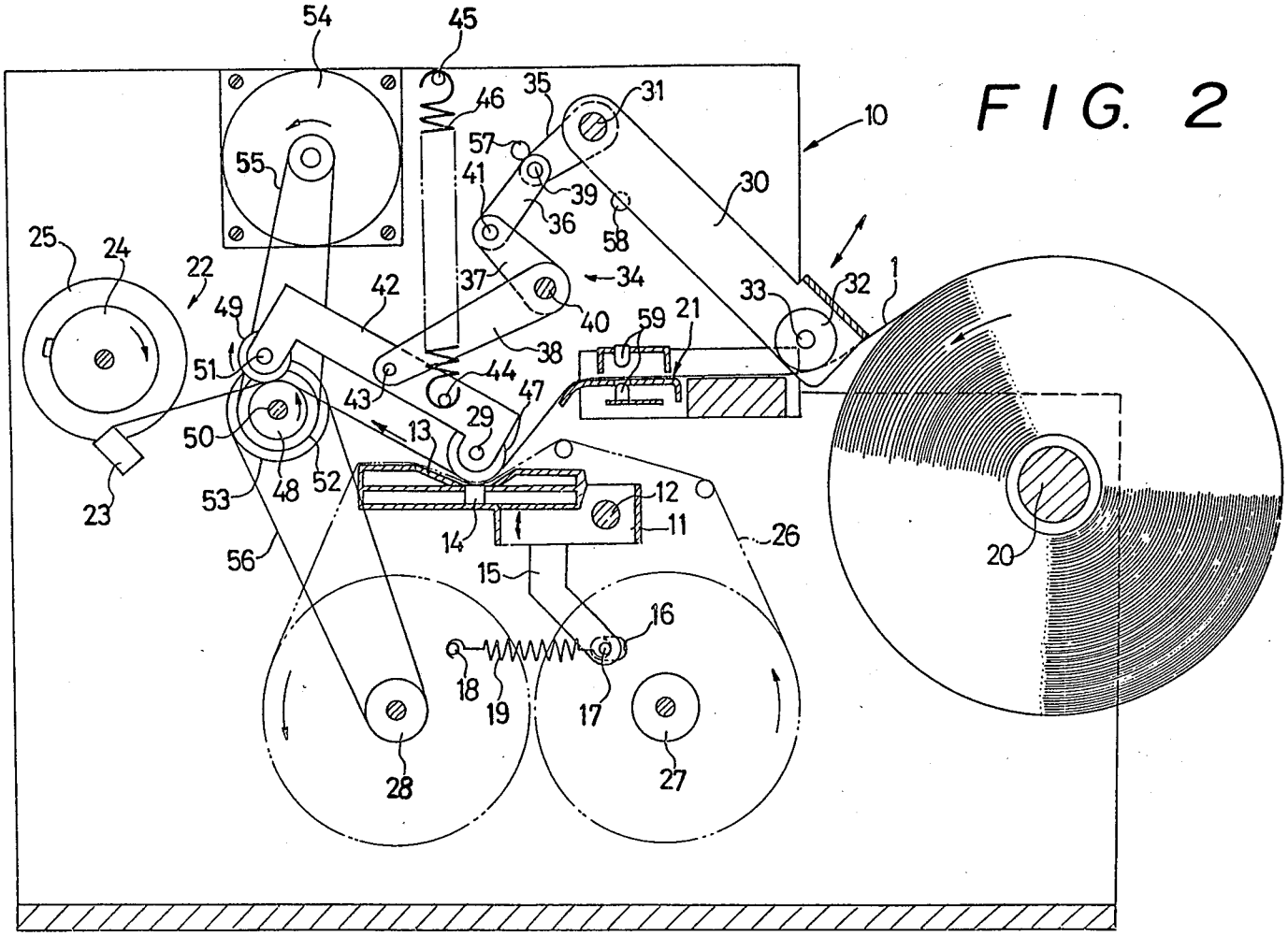

FIG. 2 shows a thermal printer of the ribbon transfer type as an example of a nonimpact printer to which the present invention is applied. A printing head support member 11 is pivotally supported by a pivot shaft 12 in a main body 10. The head support member 11 has a recess 13 in its top surface, which receives a thermal printing head 14. An arm 15 is formed integrally with and extends below the lower portion of the head support member 11. A pin 17 is fixed to the distal end of the arm 15 and is movable within a horizontally elongate hole 16 formed in the main body 10. A spring 19 is hooked between the pin 17 and another pin 18 fixed to the main body 10 so as to normally bias the head support member 11 clockwise in FIG. 2 around shaft 12.

The strip of printing paper 1 as shown in FIG. 1 is wound on a printing paper supply roller 20 which is rotatably mounted on the main body 10. The strip of printing paper 1 supplied from the printing paper supply roller 20 is guided to a cutting mechanism 22 having a stationary blade 23 and a rotary blade 24 along a predetermined conveyance path 21 above the printing head 14. The blade 24 is driven by a motor 25 through a one-way clutch (not shown). When the strip of printing paper 1 reaches the cutting mechanism 22, it is cut at its cutting line 4 shown in FIG. 1 by the stationary blade 23 and the rotary blade 24.

A heat-transfer type printing ribbon 26 is wound on a ribbon supply roller 27 which is rotatably mounted at the lower portion of the main body 10. The printing ribbon 26 supplied from the ribbon supply roller 27 is wound onto a ribbon take-up roller 28 rotatably mounted on the main body 10 after the ribbon 26 passes through a gap between the strip of printing paper 1 and the printing head 4.

One end of an operation member 30 in the form of a lever is pivotally mounted on a pivot shaft 31 fixedly located at the upper portion of the main body 10. A printing paper guide member 32 in the form of a roller is rotatably mounted by a shaft 33 on the other end of the operation member 30.

The pivoting operation of the operation member 30 is transmitted to a roller support member 42 through a link mechanism 34 comprised of levers 35, 36, 37 and 38. The level 35 is fixed to the operation member 30 in the vicinity of the pivot shaft 31 to fixedly move together with the pivoting operation member 30. The lever 36 is pivotally mounted on the lever 35 through a pin 39. The lever 36 is, in turn, pivotally mounted through a pin 41 on the lever 37 which is pivotally mounted on the main body 10 through a fixedly located pivot shaft 40. One end of the lever 38 is fixed to the lever 37 in the vicinity of the pivot shaft 40, such that the levers 37 and 38 are fixed to pivot together. There is a U-shaped support member 42 for the roller. The central portion of the roller support member 42 having a U-shaped section is pivotally mounted on the other end of the lever 38 through a pin 43. The roller support member 42 is linked to the operation member 30 through the link mechanism 34.

A pin 44 is fixed to the roller suppor member 42. A spring 46 is hooked between the pin 44 and a pin 45 mounted on the main body 10 so as to normally bias the roller support member 42 counterclockwise in FIG. 2. A platen member 47 in the form of a roller is pivotally mounted on one end of the roller support member 42 through a pin 29. The printing head 14 of the head support member 11 is urged against the platen member 47, through the strip of printing paper 1 and the printing ribbon 26, by the spring 19 which pivots the lever 15 clockwise and thus moves the head 14 upward.

A pair of conveyor rollers 48 and 49 for conveying the strip of printing paper 1 are rotatably supported respectively by a shaft 50 mounted on the main body 10 and by a pin 51 mounted on the roller support member 42. The one-way clutch (not shown) is interposed between the driving conveyor roller 48 and the shaft 50, so that the conveyor roller 48 can rotate only in the counterclockwise direction to convey the strip of printing paper 1 to the left in FIG. 2.

The shaft 50 supporting the conveyor roller 48 also securely supports coaxial timing pulleys 52 and 53 so that the timing pulleys 52 and 53 rotate together with the conveyor roller 48. The timing pulley 52 is coupled to a motor 54 mounted on the main body 10 through a timing belt 55, while the timing pulley 53 is coupled to the ribbon take-up roller 28 through a timing belt 56. There are stoppers 57 and 58 mounted on the main body 10 for regulating the range of pivotal movement of the lever 35. A photosensor 59 detects the detection holes 3 on the strip of printing paper 1 as they pass the sensor 59. The conveying operation of the strip of printing paper 1 is controlled by an output signal from the photosensor 59.

The loading of the strip of printing paper 1 and of the printing ribbon 26 and the mode of overall printing is now described.

The strip of printing paper 1 is loaded on the printing paper supply roller 20. At the same time, the operation member 30 is operated from the state shown in FIG. 2 to the state shown in FIG. 3. As a result, the printing guide roller 32 is moved upward from the position on the conveyance path 25 by a sufficient distance. The counterclockwise pivotal movement of the operation member 30 is transmitted to the roller support member 42 through the link mechanism 34. Then, the roller support member 42 pivots counterclockwise in FIGS. 2 and 3, due to the biasing force of the spring 46, about the conveyor roller 49, which is urged against the conveyor roller 48. This raises the platen member 47 upward and separates it from the position of the printing head 14 by a sufficient distance for loading. In the state shown in FIG. 3 wherein the printing paper guide member 32 and the platen member 47 are respectively separated from the conveyance path 21 and the printing head 14, the lever 35 is urged against the right-hand stopper 58 by the biasing force of the spring 46 in a stable manner. The strip of printing paper 1 may then be loaded. To enable the strip of printing paper 1 to be inserted through the gap between the conveyor rollers 48 and 49, the roller support member 42 is first pivoted clockwise, as indicated by the member as shown in the alternate long and two short dashed line form in FIG. 3, so as to separate the driven conveyor roller 49 from the driving conveyor roller 48. Then the support member is released to return to its solid line position.

Figure 3:
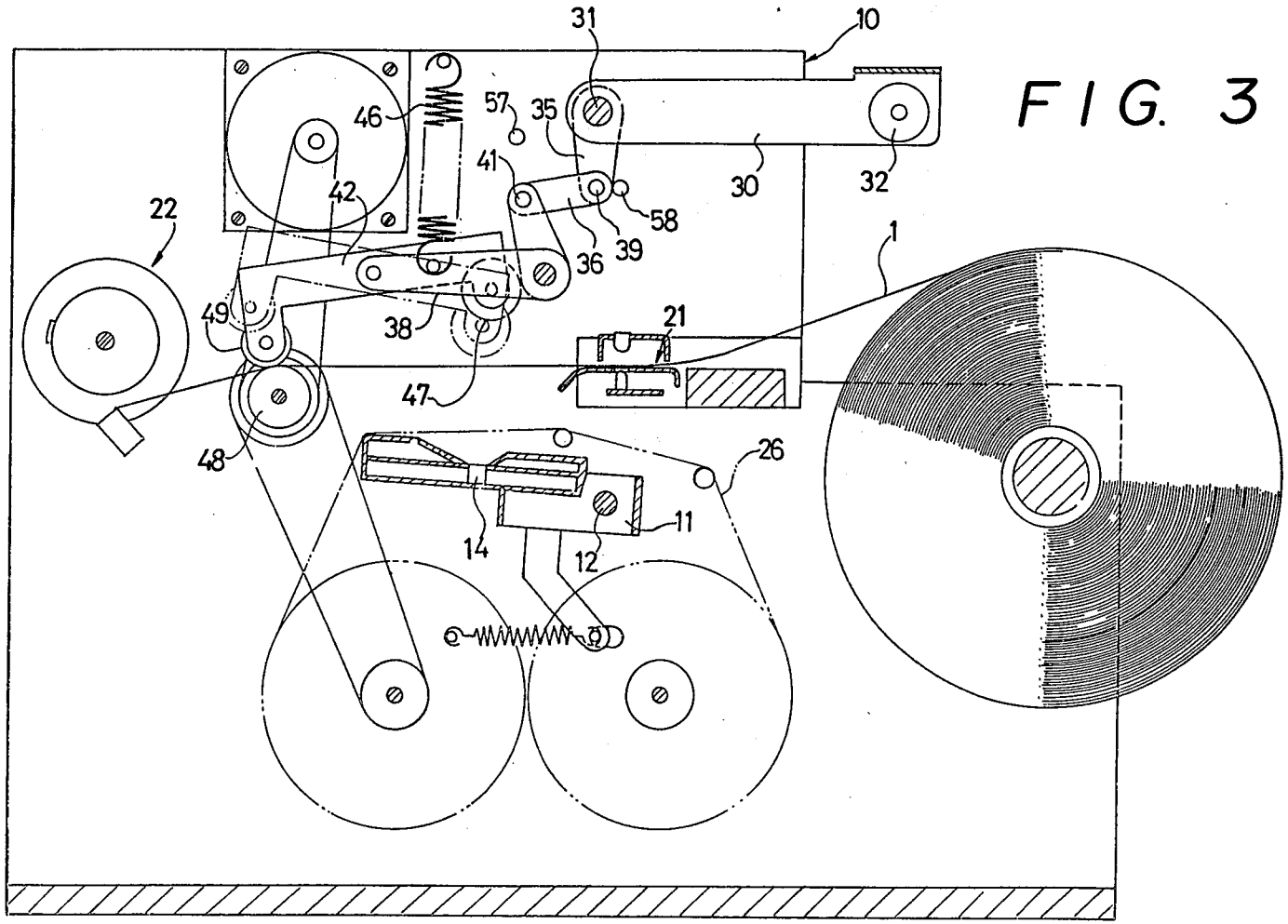

When insertion of the strip of printing paper 1 is completed, the operation member 30 is pivoted from the uplifted state shown in FIG. 3 to its state shown in FIG. 2. Then, the center of the pin 39 coupling the levers 35 and 36 lies slightly beyond the line connecting the pivot shaft 31 and the pin 41, so that the lever 35 is urged against the stopper 57 by the biasing force of the spring 46 in a stable manner. Upon the above-noted pivotal movement of the operation member 30, the printing paper guide member 32 moves close to the conveyance path 21 to guide the strip of printing paper 1 along the conveyance path 21. At the same time, the platen member 47 presses the head support member 11 downward against the biasing force of the spring 19, until the head support member 11 is urged against the printing head 14. When the printing paper guide member 32 and the platen member 47 have operated in this manner, the leading end of the strip of printing paper 1 is pulled. However, since the conveyor roller 48 may not rotate clockwise (FIG. 2) due to the action of the one-way clutch, the distal end of the strip of printing paper 1 may not be shifted in the lengthwise and widthwise directions thereof.

The description given above is of the operation for loading the strip of printing paper 1. However, a similar operation may be performed for loading or unloading the printing ribbon 26. The printing ribbon 26 may only be loaded or unloaded after the operation member 30 has been operated to remove the printing paper guide member 32 and the platen member 47 from the conveyance path 21 and the printing head 14, respectively.

After the strip of printing paper 1 and the printing ribbon 26 are loaded in this manner, they are conveyed by the intermittent rotation of the motor 54. During the time the strip of printing paper 1 and the printing ribbon 26 are conveyed in this manner, information is printed on the strip of printing paper 1 by the printing head 14. Each tag is then cut off from the printed strip of printing paper 1 at the corresponding cutting line 4 by the cutting mechanism 22.

In the example described above, the printing paper guide member 32 is mounted on the operation member 30. However, the printing paper guide member 32 may be mounted on any member which is interlocked with the operation member 30 such that it may be brought close to or separated from the conveyance path 21. Furthermore, the printing paper guide member 32 and the platen member 47 comprise rollers in the embodiment described above for the purpose of reducing contact resistance with the strip of printing paper 1 to the minimum. However, the printing paper guide member 32 and the platen member 47 may alternatively comprise pins or plates. In the embodiment described above, the one-way clutch is mounted on the driving conveyor roller 48 among the pair of conveyor rollerss 48 and 49. However, a one-way clutch may be mounted on the driven conveyor roller 49, or on both of the conveyor rollers 48 and 49.

In accordance with the guide device of the present invention, movement of the operation member 30 can bring the printing paper guide member 32 close to the conveyor path 21 and separate it therefrom, and can also urge the platen member 47 against the printing head 14, and separate it therefrom. Therefore, loading of the strip of printing paper 1 is facilitated. Since the operation member 30 and the platen member 47 are coupled by the link mechanism 34, the range of movement of each part is very small even if the platen member 47 is spaced considerably apart from the printing head 14. Therefore, movement of each part may not interfere with the remaining parts and the overall device may be made compact in size.

In the device described above, at least one of the conveyor rollers 48 and 49 for conveying the strip of printing paper 1 sandwiched therebetween rotates only in the conveying direction. Accordingly, the strip of printing paper 1 may not be shifted in the lengthwise and widthwise directions when either the printing paper guide member 32 or the platen member 47 is set. The strip of printing paper 1 may not, therefore, be separated from the conveyor rollers 48 and 49, and the printing position may not be deviated from the normal printing position.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. In a nonimpact printer, a guiding device for guiding an elongate strip of paper through the printer, comprising:

a printer frame;

a paper strip conveyance path through the printer;

means for conveying the strip of paper along the conveyance path;

an operation member supported by and pivoted on the frame, said operation member being moveable between a first and a second position;

a paper guide member connected with the operation member, said guide member being moveable in synchronism with the operation member to a close position located toward the conveyance path when the operation member is moved to the first position so as to move the paper strip onto the conveyance path, and to a separated position located away from the conveyance path when the operation member is moved to the second position so as to locate the paper strip away from the conveyance path, the separated position of the guide member permitting installation of the paper strip in the printer;

a nonimpact printing head located downstream of the guide member along the conveyance path;

a platen member in opposition to the printing head;

a support member supported by and pivoted on the frame, said platen member being supported on the support member for pivotable movement therewith between an urging position where the paper strip is urged against the printing head, and a divided position where the paper strip is separated from the printing head, said divided position permitting installation of the paper strip between the platen and the printing head;

and a link mechanism consisting of a plurality of links, said link mechanism constraining said support member for movement in response to movement of the operation member whereby said link mechanism moves the platen member between the urging position and the divided position in synchronism with the movement of the operation member between the first and second positions respectively.

2. The guiding device of claim 1, further comprising an imprintable ribbon and means for conveying the ribbon between the printing head and the paper strip on the conveyance path.

3. The guiding device of claim 1, wherein the conveying means comprises a pair of conveyor rollers between which the paper strip may be sandwiched, and comprises means for rotating at least one of the conveyor rollers for conveying the paper strip along the conveyance path in the printer.

4. The guiding device of claim 3, wherein the at least one roller is rotatable only in the conveyance direction of the paper strip.

5. The guiding device of claim 3, further comprising cutting means located downstream of the printing head and after the conveyor rollers in the conveyance path, for cutting individual pieces from the paper strip after each such piece has been printed.

6. The guiding device of claim 1, further comprising a sensor for determining the extent to which the paper strip has been conveyed along the conveyance path, and the sensor being connected with the printing head for causing imprinting of the paper strip at selected intervals along the paper strip.

7. The guiding device of claim 1, further comprising cutting means located downstream the printing head in the conveyance path of the paper strip for cutting individual pieces from the paper strip after the individual pieces have been printed.

8. The guiding device of claim 1, wherein the operation member comprises a lever pivoted to the frame to pivot between its first and second positions; the guide member being supported on the lever, and being moved between its close and separated positions respectively, as the lever pivots.

9. The guiding device of claim 1, wherein the conveyance path includes a paper strip support for guiding the paper strip, and the guide member is moved to the close position by moving generally toward the paper strip support to thereby guide the paper to the conveyance path.

10. The guiding device of claim 1, further comprising means for biasing the printing head against the platen member.

11. The guiding device of claim 1, wherein the support member has a support member roller thereon spaced away from the platen member;

the conveying means comprises a pair of conveyor rollers between which the paper strip may be sandwiched, and comprises means for rotating at least one of the conveyor rollers for conveying the paper strip along the conveyance path in the printer;

the other of the pair of conveyor rollers being the support member roller.

12. The guiding device of claim 1, wherein the platen member comprises a platen member roller carried on the support member, whereby the paper strip is rolled on the platen member roller past the printing head.

13. The guiding device of claim 1, further comprising an imprintable ribbon and means for conveying the ribbon between the printing head and the paper strip on the conveyance path.

* * * * *